United States Patent [19]

Takahashi et al.

[11] 4,283,997

[45] Aug. 18, 1981

[54] REFRIGERANT COMPRESSORS

[75] Inventors: Haruo Takahashi, Takasaki; Shougo Kimura, Gunma, both of Japan

[73] Assignee: Sankyo Electric Company Limited, Isesaki, Japan

[21] Appl. No.: 67,012

[22] Filed: Aug. 16, 1979

[30] Foreign Application Priority Data

Aug. 22, 1978 [JP] Japan ..... 53-101420
Aug. 22, 1978 [JP] Japan ..... 53-101421

[51] Int. Cl.[3] ..... F01B 31/00; F04B 1/18; F04B 39/04

[52] U.S. Cl. ..... 92/79; 417/269

[58] Field of Search ..... 417/269, 270; 92/79

[56] References Cited

U.S. PATENT DOCUMENTS

| | | | |
|---|---|---|---|
| 3,587,406 | 6/1971 | Gannaway | 417/437 |
| 3,676,024 | 7/1972 | Akaiki | 417/269 |
| 4,005,948 | 1/1977 | Hiraga | 417/269 |
| 4,073,603 | 2/1978 | Abendschein | 417/270 |

*Primary Examiner*—William L. Freeh
*Attorney, Agent, or Firm*—Hopgood, Calimafde, Kalil, Blaustein & Judlowe

[57] ABSTRACT

A refrigerant compressor unit which includes a balance hole communicating between the crank chamber and the suction chamber for returning blow-by gas in the crank chamber to the suction chamber. The unit is provided with an oil collecting zone within the discharge chamber and has an oil accumulating chamber formed on a lower portion of the cylinder head. Oil mixed with compressed refrigerant gas within the discharge chamber adheres the inner surface of the discharge chamber and flows into the collecting zone. The collected oil is accumulated in the accumulating chamber and returns to the crank chamber through an oil passageway between the accumulating chamber and the crank chamber, thereby reducing the oil leakage into the refrigerant circulating system.

10 Claims, 12 Drawing Figures

REFRIGERANT COMPRESSORS

BACKGROUND OF THE INVENTION

This invention relates generally to refrigerant compressor units and, in particular, to a refrigerant compressor in which oil is separated from the compressed refrigerant gas.

A conventional refrigerant compressor unit comprises a compressor housing, a cylinder block mounted therein having a plurality of cylinders, and a plurality of pistons respectively slidably and closely fitted within the cylinders. The pistons are driven within the cylinders to compress refrigerant gas. The compressor housing includes a chamber adjacent the cylinder block containing piston driving elements, and a cylinder head having a suction chamber and a discharge chamber which operatively communicate with the cylinders.

A charge of refrigerant gas and lubricating oil is introduced into the compressor unit. In the operation of the compressor, the refrigerant gas is compressed by the pistons reciprocating within corresponding cylinders. The compressed refrigerant gas circulates from the discharge chamber through the cooling system and returns to the compressor unit at the suction chamber. The lubricant oil passes into the crank chamber together with the refrigerant gas as blow-by through the gap between the piston and the inner wall of its corresponding cylinder to lubricate therebetween. The lubricant oil is separated from the refrigerant gas in the crank chamber and lubricates the moving parts therein.

In order to return the blow-by gas into the suction chamber, the conventional compressor unit is provided with a passageway or a balance hole which communicates between the crank chamber and the suction chamber. Accordingly, the lubricant oil returns to the suction chamber to lubricate the pistons and cylinders.

However, the oil mixed with the refrigerant gas passes through the outlet port and circulates in the cooling system and contaminates the inner wall of the conduits in that system. This means not only that lubricant oil is wasted unreasonably, but also that the efficiency of heat exchange in the system is lowered.

SUMMARY OF THE INVENTION

It is an object of this invention to provide a refrigerant compressor unit wherein any oil mixed with the compressed refrigerant gas is prevented from circulating through the cooling system together with the refrigerant gas.

It is another object of this invention to provide a refrigerant compressor in which a significant decrease in the waste of lubricating oil is achieved together with an increase in the efficiency of heat exchange in the cooling system.

It is still another object of this invention to provide a refrigerant compressor wherein the lubricating oil which is separated from the compressed refrigerant gas discharged into a discharge chamber by adhesion onto the inner surface of the discharge chamber is collected and returned to the crank chamber without a remixing of the oil into the refrigerant gas.

It is yet another object of this invention to provide a refrigerant compressor wherein the lubricating oil separated from the compressed refrigerant gas within the discharge chamber is used to lubricate moving parts of the compressor before its return to the crank chamber.

It is a further object of this invention to carry out these objects in a simple construction.

According to the invention, the refrigerant compressor unit includes a drive shaft supported by a bearing in the front end of the compressor housing and which extends through the front end. The front end of the compressor housing is provided with a shaft seal cavity which communicates with the interior of the compressor housing along the drive shaft. Means are provided within the discharge chamber of the compressor unit for collecting oil which blows into the discharge chamber together with the compressed refrigerant gas and which adheres onto the inner surface of the discharge chamber, without the oil remixing into the refrigerant gas in the discharge chamber. To this end, an oil collecting chamber is formed within the discharge chamber by mounting a separator plate to separate the discharge chamber into a front chamber adjacent the cylinders and a rear chamber. The front and rear chambers communicate with each other through a gap between the upper end of the separator plate and the upper portion of the inner wall of the discharge chamber. The front chamber is connected to an outlet port through a conduit which is provided in the separator plate. The separator plate is also provided with a groove in its front end surface which groove extending along the inner wall of the discharge chamber to connect with the gap. The oil which adheres onto the inner surface of the discharge chamber flows along the groove and into the rear chamber through the gap. The cylinder head is also provided with an oil accumulating chamber at a lower portion of the discharge chamber. The accumulating chamber communicates with the rear chamber. An oil passageway is formed through the compressor housing to communicate between the accumulating chamber and the crank chamber of the compressor unit. Therefore, the oil collected in the oil collecting chamber is accumulated in the oil accumulating chamber and, thereafter, returns to the crank chamber through the oil passageway.

In a first aspect of this invention, the oil passageway is formed to communicate between the oil accumulating chamber and the shaft seal cavity. The oil returns to the crank chamber after lubricating the shaft seal cavity and the bearing which supports the drive shaft.

In a second aspect of this invention, the cylinder head is provided with a short wall to define a small chamber within the discharge chamber and adjacent the outlet port. The conduit of the separator plate is provided with a radial flange at the end thereof. The radial flange is received by, and tightly contacts, the end of the short wall so that the front chamber may be connected with the outlet port through the conduit and the small chamber.

Further objects, features and other aspects of this invention will be understood from the following detailed description of preferred embodiments of this invention referring to annexed drawings.

DETAILED DESCRIPTION OF PREFERRED EMBODIMENTS

Figure 1:
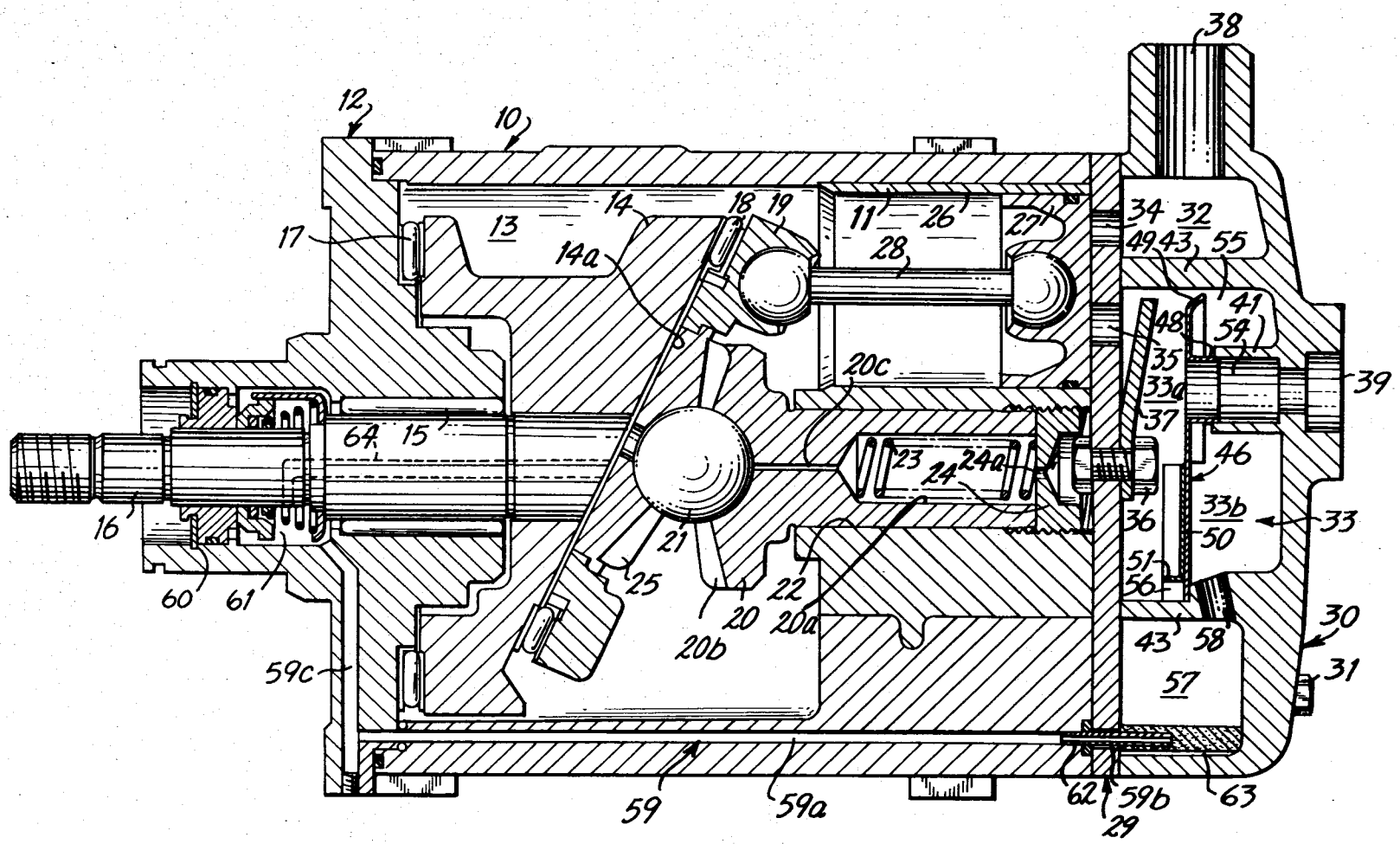
FIG. 1 is a vertical cross-sectional view of an embodiment of this invention.

The embodiment of this invention illustrated in FIGS. 1–4 comprises a substantially cylindrical housing 10, a cylinder block 11 which is fitted into and secured to the housing 10 at an end thereof, and a front housing or cover plate 12 secured to the other end of housing 10. The interior of housing 10 defines a crank chamber 13 between cylinder block 11 and front housing 12. A swash plate or cam rotor 14, which is disposed within crank chamber 13, is fixedly mounted to an inner end of a drive shaft 16. Drive shaft 16 extends through a central portion of front housing 12 and is rotatably supported by means of a bearing such as a needle bearing 15 in front housing 12. Cam rotor 14 is also supported on the inner surface of front housing 12 by means of a thrust needle bearing 17. In crank chamber 13, a wobble plate 19 is disposed in close proximity with the sloping surface 14*a* of cam rotor 14 with a thrust needle bearing 18 therebetween. Wobble plate 19 is nutatably but non-rotatably supported on a ball bearing 21 seated at an end of a supporting member 20.

Supporting member 20 comprises a shank portion having an axial hole 20*a* at its other end and a bevel gear portion 20*b* at the end of the shank portion which includes a seat for the ball bearing 21 at its center. Supporting member 20 is axially slidably but non-rotatably supported on cylinder block 11 by inserting the shank portion into a central axial hole 22 formed in cylinder block 11. The rotation of supporting member 20 is prevented by means of a key and a key groove (not shown). A coil spring 23 is disposed in axial hole 20*a* of the supporting member. The outer end of spring 23 is in contact with a screw member 24 screwed into central hole 22 of cylinder block 11, so that supporting member 20 is urged toward wobble plate 19. Bevel gear portion 20*b* of supporting member 20 engages a bevel gear 25 mounted on wobble plate 19 so that rotation of the wobble plate is prevented. Ball bearing 21 rides in the seat formed at a central portion of bevel gear portion 20*b* and also rides in a seat formed at a central portion of bevel gear 25, so that wobble plate 19 is nutatably but non-rotatably supported on the ball bearing 21.

Cylinder block 11 is provided with a plurality of axial cylinders 26 formed therein, within which pistons 27 are respectively slidably and closely fitted. Pistons 27 are connected with wobble plate 19 by a plurality of piston rods 28. The connection between the piston rods and the pistons and the connection between the piston rods and the wobble plate are made by ball joint mechanisms.

On the outer end of cylinder block 11, a cylinder head 30 is disposed and is secured to the cylinder block by means of bolts 31, an interposing gasket member (not shown) and a valve plate assembly 29 therebetween.

Figure 2:
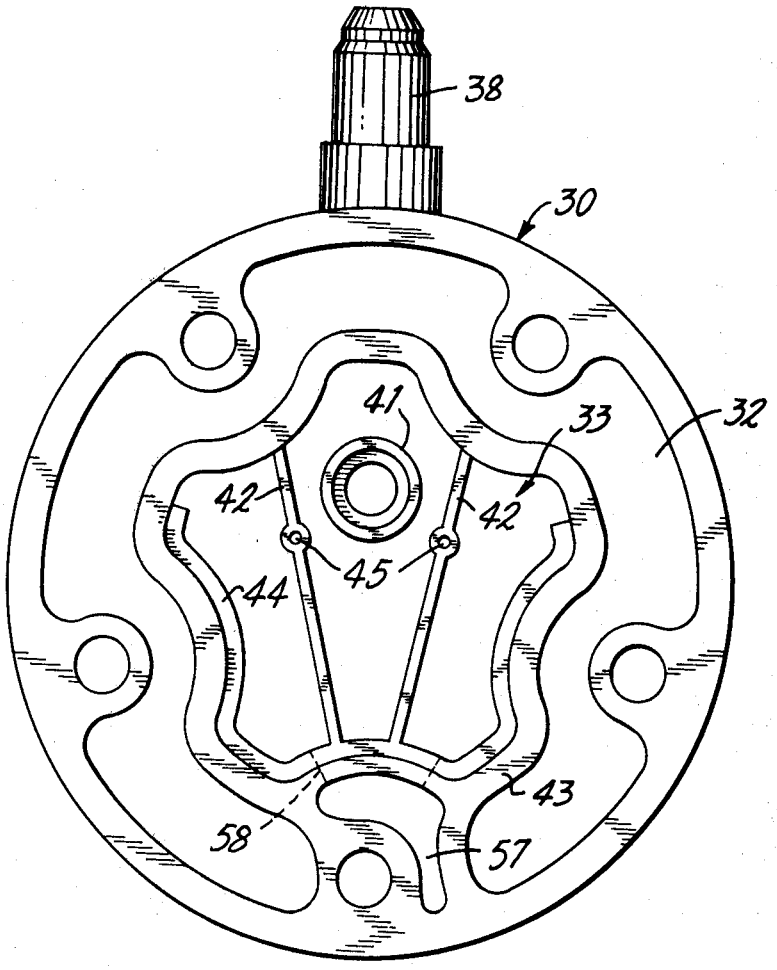
FIG. 2 is a front view of a cylinder head used in the embodiment of FIG. 1.

Referring to FIGS. 1 and 2, cylinder head 30 is provided with a suction chamber 32 and a discharge chamber 33 separated by a partition wall 43. Valve plate assembly 29 comprises a valve plate having suction ports 34 connecting between suction chamber 32 and respective cylinders 26, and discharge ports 35 connecting between discharge chamber 33 and respective cylinders 26. The valve plate assembly 29 also includes a suction reed valve member (not shown), a discharge reed valve member (not shown), a stopper plate 37 for suppressing excessive deformation of the discharge reed valve member, and bolt and nut means 36 for securing the suction and discharge reed valve members and the stopper member to the valve plate.

In the operation of the compressor as described above drive shaft 16 is driven by any suitable means, such as an automobile engine. Cam rotor 14 rotates together with the drive shaft, so that wobble plate 19 nutates about bearing ball 21 according to the rotation of sloping surface 14*a* of cam rotor 14. The nutation of wobble plate 19 causes reciprocating movement of respective pistons 27 within cylinders 26. Therefore, the intake and compression of the refrigerant gas is repeatedly performed in each cylinder. Thus, the refrigerant gas circulates through a cooling circuit which is connected between an inlet port 38 and an outlet port 39 of cylinder head 30. During the operation of the compressor, part of the refrigerant gas in each cylinder passes into crank chamber 13 as a blow-by gas through the gap between an inner wall of cylinder 26 and piston 27.

Figure 3:
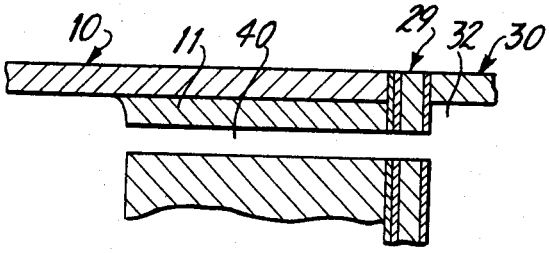
FIG. 3 is a sectional view of a part of the embodiment of FIG. 1, illustrating the balance hole.

As best shown in FIG. 3, in order to return the blow-by gas to suction chamber 32, a passageway 40, which is a so called balance hole, is formed in cylinder block 11 and through valve plate assembly 29 to communicate between crank chamber 13 and suction chamber 32. Lubricating oil contained in the crank chamber is agitated and splashed during operation of the compressor and lubricates the internal moving parts in the form of an oil mist.

A part of the agitated oil mist in the crank chamber flows into suction chamber 32 together with the returning refrigerant gas through balance hole 40, and is drawn into respective cylinders to lubricate the gap between the pistons and the inner walls of the cylinders. But a part of the oil mist will be discharged to the discharge chamber together with the compressed refrigerant gas and, thereafter, circulates into the cooling circuit. The leakage of oil into the cooling circuit can cause various disadvantages as previously described.

In the refrigerant compressor unit of the invention, means described more completely below, are provided for preventing oil from flowing through the cooling circuit and for returning the oil flowing into the discharge chamber to the crank chamber.

Figure 4:
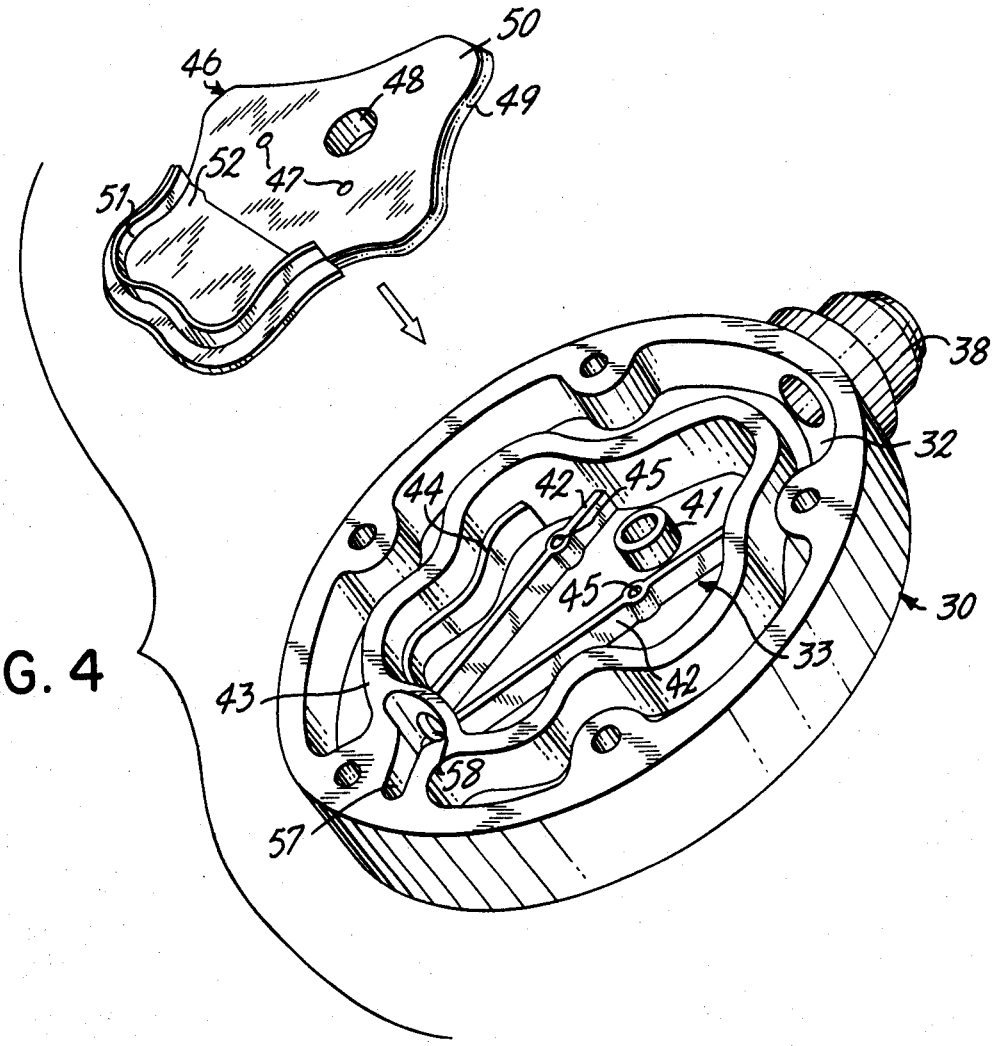
FIG. 4 is an exploded perspective view of the cylinder head with the partitioning means in the embodiment of FIG. 1.

Referring to FIGS. 2 and 4, cylinder head 30 is provided with an annular projection 41 and two walls 42, both of which project axially from the inner surface of the rear end wall of discharge chamber 33. Annular projection 41 defines a hole therein communicating with outlet port 39. Projecting walls 42 are formed with a small tapped hole 45 for receiving a screw member (not shown) on the axial end surface thereof. The axial length of the projecting walls 42 is longer than that of the annular projection 41, but is shorter than that of partition wall 43. At the lower portion of discharge chamber 33, a step 44 is formed to extend along the inner surface of partition wall 43 so that the axial side surface of step 44 lies on the same radial plane as the axial end surface of projecting walls 42. Annular projection 41, projecting walls 42 and step 44 are integrally formed with cylinder head 30.

An oil accumulating chamber 57 is formed at a portion of cylinder head 30 lower than discharge chamber 33, and communicates with discharge chamber 33 through a hole 58 which is formed in partition wall 43 at an axial position between the end wall of cylinder head 30 and the axial side surface of step 44.

Figure 5:
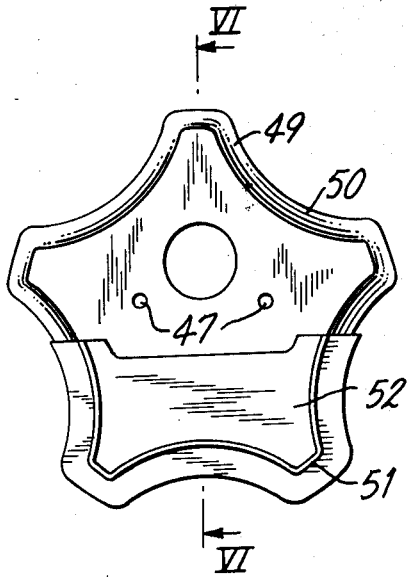
FIG. 5 is a plan view of the partitioning means used in the embodiment of FIG. 1.
Figure 6:
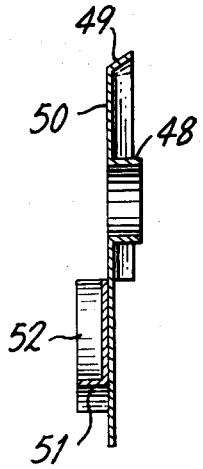
FIG. 6 is a vertical cross-sectional view of the partitioning means taken along line VI—VI in FIG. 5.
Figure 7:
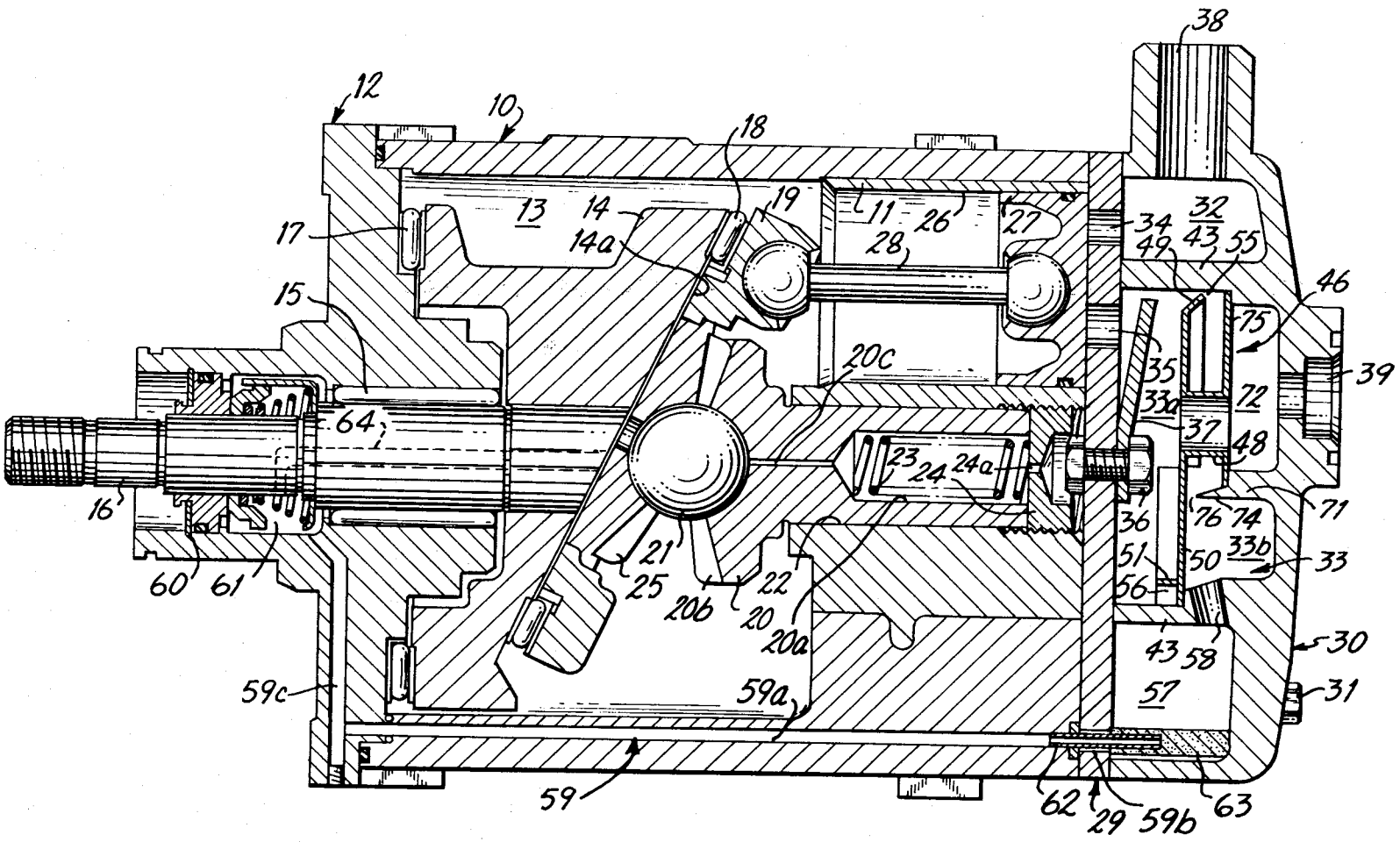
FIG. 7 is a vertical cross-sectional view of a refrigerant compressor unit according to another embodiment of this invention.
Figure 8:
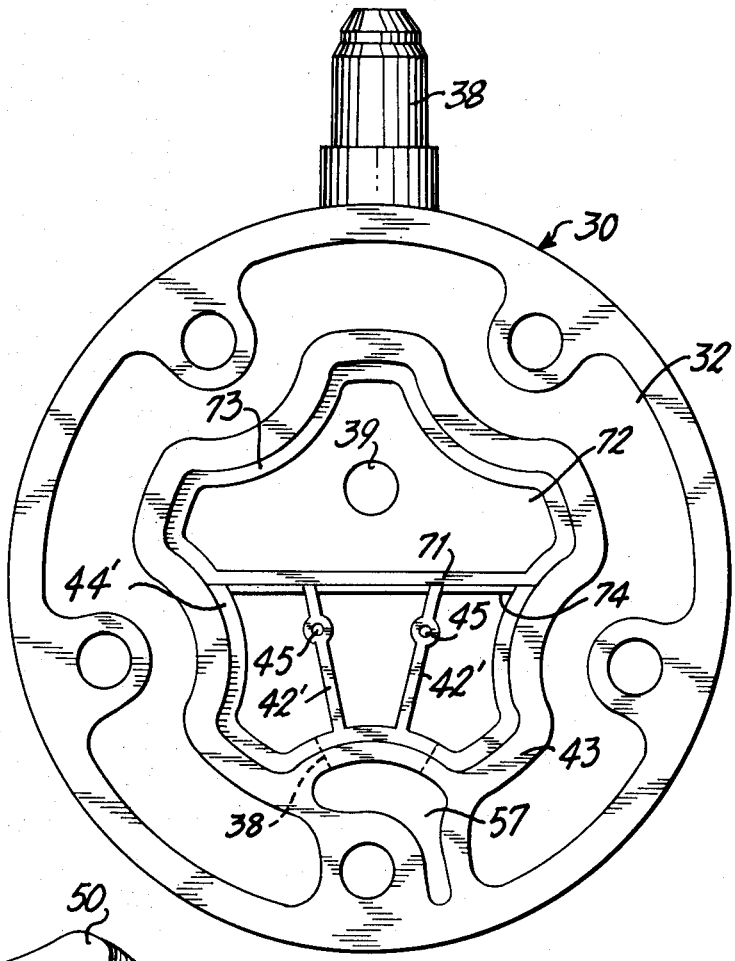
FIG. 8 is a front view of a cylinder head used in the embodiment of FIG. 7.
Figure 9:
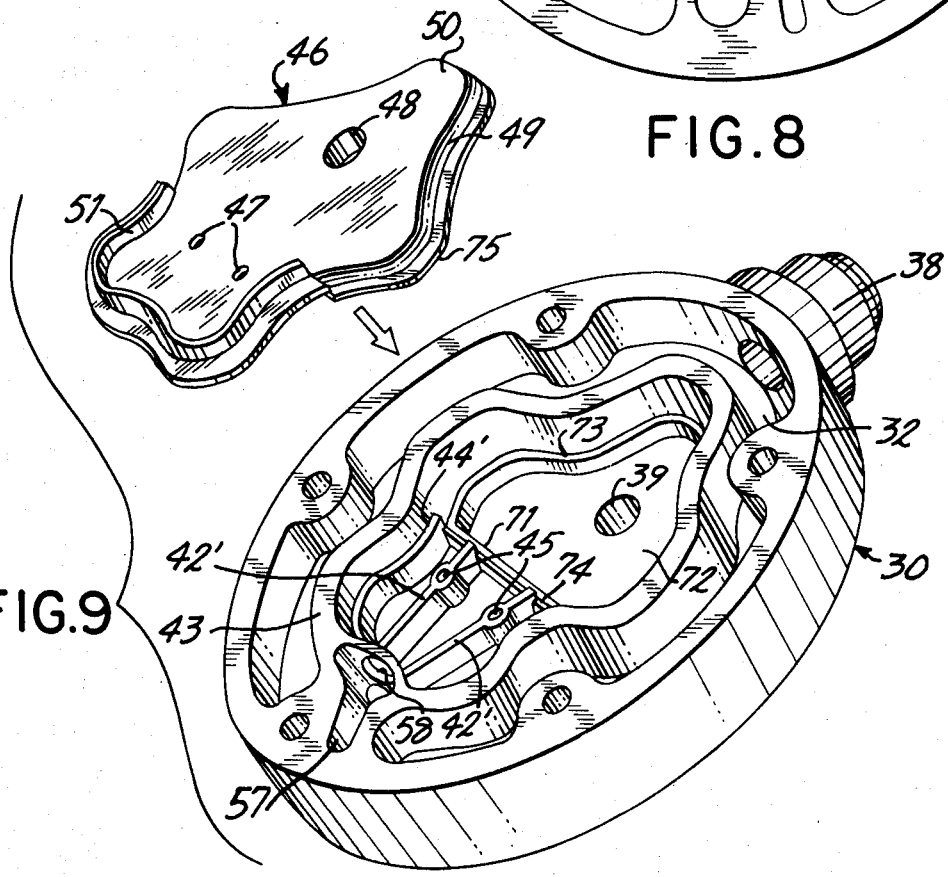
FIG. 9 is an exploded perspective view of the cylinder head with the separating means in the embodiment of FIG. 7.

Partitioning means 46 are disposed within discharge chamber 33 to separate the discharge chamber into two spaces **33*a* and 33*b*, as shown in FIG. 1. The partitioning means 46 includes, as shown in FIGS. 5 and 6, a plate member 50 of a shape generally, conforming with the inner contour of partition wall 43 defining the discharge chamber. Plate member 50 has two small openings 47 and a tubing portion or a conduit 48 extending in a rearward direction. The upper peripheral end portion of the plate member 50 is bent backwards along its peripheral end, as shown at 49. A deflector plate 52 is affixed onto the front surface of plate member 50 at the lower portion. The deflector plate 52 is formed with a guide wall 51 which, in turn, extends along the front surface of plate member 50 and extends perpendicularly at the lower peripheral portion of plate member 50** along its peripheral end.

Referring to FIG. 4, plate 50, to which deflector 52 is affixed, is inserted into discharge chamber 33 and is received on the axial end surface of projecting walls 42 and step 44 so that the conduit means 48 are closely fitted into the annular projection 41 of cylinder head 30. Plate member 50 is secured to the cylinder head by the screw members which are screwed into tapped hole 45 of projecting walls 42 through small openings 47 of the plate. Thus, discharge chamber 33 is separated by plate 50 into a front space **33*a* and a rear space 33*b*. The front, or first, space 33*a* is adjacent valve plate assembly 29, and communicates with outlet port 39 through a gas passageway 54 which is defined by conduit 48 and annular projection 41, as shown in FIG. 1. The other, or second, space 33*b* communicates with oil accumulating chamber 57 through hole 58. First space 33*a* and second space 33*b* mutually communicate through an upper peripheral gap 55 which remains between upper bent portion 49 of plate 50 and the partition wall 43 corresponding thereto. At the lower portion of first space 33*a*, guide wall 51 extends along partition wall 43, so that a groove 56 is defined by guide wall 51, partition wall 43 and plate 50 along the inner surface of partition wall 43. Opposite ends of the groove 56 connect with gap 55**.

In the operation of the embodiment of FIGS. 1–6, the mixture of refrigerant gas and oil mist compressed in the cylinders enters first space **33*a* of discharge chamber 33 through respective discharge ports 35. When the mixture strikes the inner surface of partition wall 43, the oil adheres on the partition wall and flows thereon. The oil flowing on partition wall 43 at its upper portion is forced to flow towards gap 55 by the discharging compressed gas and flows into second space 33*b* through gap 55. On the other hand, the oil flowing on the inner surface of partition wall 43 at its lower portion is forced to flow into groove 56 by the discharged compressed gas and is carried along groove 56 to gap 55 by the gas flow which flows up the groove to enter conduit 48. So that the oil flows into second space 33*b* through the gap 55. The refrigerant gas, after striking partition wall 43, flows along plate member 50 and into gas passageway 54, from which it circulates to the external cooling circuit through outlet port 39. Accordingly, the amount of oil circulating to the external cooling circuit together with the refrigerant gas is considerably reduced. The oil flowing into the second space 33*b*, thereafter, flows into oil accumulating chamber 57 through hole 58**.

In this embodiment, an oil passageway 59 is formed to communicate oil accumulating chamber 57 with a shaft seal cavity 61 formed in front housing 12, in order to return the separated and accumulated oil into the crank chamber 13. Oil passageway 59 includes a first oil hole **59*a* axially extending through the side wall of cylindrical housing 10, a second oil hole 59*b* axially formed in valve plate assembly 30 in registry with first oil hole 59*a* to connect first oil hole 59*a* with a lower portion of oil accumulating chamber 57. A third oil hole 59*c* is formed in front housing 12 to communicate first oil hole 59*a* with the shaft seal cavity 61. Thus, the separated and accumulated oil in the oil accumulating chamber 57 flows into shaft seal cavity 61 through oil passageway 59. A shaft seal assembly 60 is disposed in shaft seal cavity 61 on drive shaft 16 extending therethrough. Drive shaft 16 is provided with an oil passageway 64 which communicates between shaft seal cavity 61 and the gap between rotor 14 and wobble plate 19. A part of the oil returns from shaft seal cavity 61 to crank chamber 13 after lubricating needle bearing 15 supporting drive shaft 16 and thrust needle bearing 17. The other part of the return oil flows through oil passageway 64 into crank chamber 13 to lubricate needle bearing 18**.

An orifice member 62 is disposed in oil hole **59*a* to prevent the compressed refrigerant gas from leaking to crank chamber 13 through oil passageway 59. If any one of oil holes 59*a*–59*c* is sufficiently small to prevent gas from flowing from oil accumulating chamber 57 to crank chamber 13 through oil passageway 59, orifice 62 need not be used. A filter 63 is disposed in oil accumulating chamber 57** for removing particles from the separated oil.

Furthermore, in this embodiment, supporting member 20 is formed with a small hole **20*c* extending between the ball seat of the end surface thereof and axial hole 20*a*. Screw member 24 is also formed with an axial hole 24*a*. Accordingly, the high pressure gas mixture leaks from first space 33*a* of the discharge chamber to central axial hole 22 of cylinder block 11 through a gap along the peripheral surface of bolt 38, and the leaked gas flows to ball bearing 21 through holes 24*a*, 20*a*, and 20*c* so that ball bearing 21** is lubricated.

Referring to FIGS. 7–11, there is shown another embodiment, which is different from the above described embodiment in the arrangement of the partitioning means and the cylinder head. Similar parts are represented by the same reference numerals as in the embodiment shown in FIGS. 1–6, and any description of the similar parts is omitted to simplify the description. Cylinder head 30 is provided with a partitioning wall 71 transversely extending across discharge chamber 33 at a portion lower than outlet port 39, to form a recess 72 at the upper portion of discharge chamber 33. Projecting walls 42' and a first step 44' similar to the projecting walls 42 and the step 44 in the embodiment in FIGS. 1–6 are formed at the lower area of partitioning wall 71. The height of partitioning wall 71 is shorter than that of projecting walls 42'. Partition wall 43 is also formed with step 73 within recess 72 to extend along the inner surface of partition wall 43. The axial height of second step 73 is equal to that of partitioning wall 71. Partitioning wall 71 is provided with an axial fin 74 extending axially from the lower edge of the projecting end, but short of first step 44'.

Figure 10:
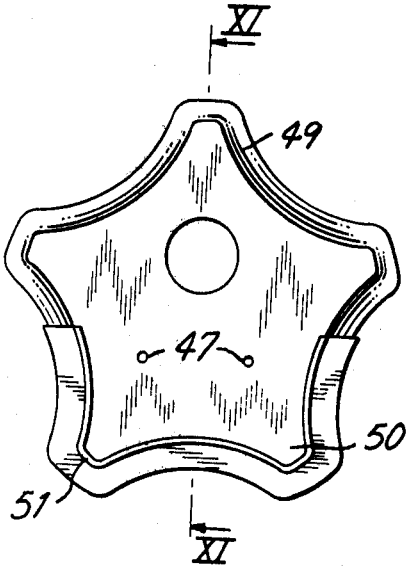
FIG. 10 is a plan view of the partitioning means used in the embodiment of FIG. 7.
Figure 11:
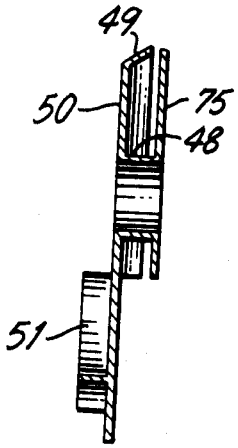
FIG. 11 is a vertical cross-sectional view of the partitioning means taken along line XI—XI in FIG. 10.

The conduit 48 of the partitioning means 46 is provided with, as best shown in FIGS. 10 and 11, a radial flange 75 at the projecting end thereof to be received on second step 73 and partitioning wall 71 at the peripheral end portion. Similar to the embodiment in FIGS. 1–6, plate 50 is secured to the cylinder head by positioning it on the axial end surface of projecting walls 42' and first step 44' and inserting screws into tapped holes 45 through holes 47. At the time, the peripheral portion of flange 71 tightly contacts with second step 73, so that conduit 48 connects with outlet port 39 through recess 72. A second gap 76 is defined between plate 50 and fin 74.

According to the above described construction of this embodiment, cylinder head 30 can be readily made by casting, because the cylinder head is formed without any small annular projection such as projection 41 in the discharge chamber 33 as shown in FIG. 1. The oil flowing into second space **33*b* through gap 55 flows down and into the zone under partitioning wall 71 through gap 76. Tin 74** prevents the refrigerant gas from flowing into the zone and agitating the oil in the zone. Moreover, the oil in the zone is prevented from flowing therefrom by vibration and mechanical shock applied to the compressor unit, or inclination of the compressor unit.

Figure 12:
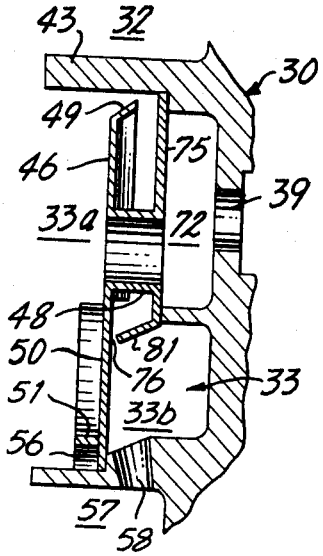
FIG. 12 is a sectional view of a main part of a further embodiment of this invention.

FIG. 12 shows a modification of the embodiment as shown in FIGS. 7–11, in which flange 75 is provided with a fin 81 bent toward plate 50 at the portion received on partitioning wall 43. Therefore, fin 74 of partitioning wall 71 is omitted in this embodiment.

According to this modification, it is understood that cylinder head 30 can be easily made by casting.

Although the invention has been described in detail in connection with preferred embodiments referring to compressors of a specific type, it will be appreciated that these are only by example, and it is understood that other modification and variations may be made by those skilled in the art and are thus within the spirit and scope of this invention.

What is claimed is:

1. In a refrigerant compressor unit of the type having a compressor housing, a cylinder block mounted within said compressor housing having a plurality of cylinders, a plurality of piston means slidably disposed within said plurality of cylinders, means for driving said piston means within said cylinders to compress refrigerant gas, said compressor housing having a first chamber adjacent said cylinder block for containing said driving means, a cylinder head having a suction chamber and a discharge chamber which operatively communicate with said cylinders, and a gas passageway communicating between said first chamber and said suction chamber to return blow-by gas in said first chamber to said suction chamber, the improvement comprising: said cylinder head being provided with a second chamber at a lower portion thereof, means for communicating said second chamber with said discharge chamber, an oil passageway communicating between said first chamber and said second chamber, partitioning means fixedly disposed within said discharge chamber to separate said discharge chamber into a first and a second spaces, said first space being a front portion of said discharge chamber and communicating with said cylinders, said second space being a rear portion of said discharge chamber and communicating with said second chamber, said partitioning means being shorter than the inner wall of said discharge chamber at the upper portion thereof to define a first gap therebetween along the inner wall of said discharge chamber through which gap said first space communicates with said second space, said partitioning means including a first plate member fixed to said cylinder head and with conduit means connecting said first space with an outlet port of said cylinder head to be connected with an external cooling circuit, a guide wall extending along the inner surface of said discharge chamber at the lower peripheral portion of said plate member and axially projecting within said first space to define a groove along the inner surface of said discharge chamber, opposite ends of said groove connecting with said first gap, whereby the oil flowing on the inner surface of said first space may be transferred to said second space directly through said first gap and/or through said first gap after flowing in and along said groove by the compressed gas flow to said conduit, and whereby the oil separated from the compressed gas within said second space may be accumulated in said second chamber and be returned to said first chamber through said oil passageway.

2. The improvement as claimed in claim 1, in which the peripheral end of said plate member along said first gap is bent into said second space.

3. The improvement as claimed in claim 1 wherein a filter is disposed in said second chamber for removing particles from said separated oil.

4. The improvement as claimed in claim 1, wherein said cylinder head is provided with said outlet port in the rear end wall thereof, an annular projection axially projecting from the inner surface of said rear end wall to define a hole therein communicating with said outlet port, a further projections axially projecting from the inner surface of said rear end wall and receiving and securing said plate member on projecting ends thereof, said conduit means of said plate member being fitted into said annular projection.

5. The improvement as claimed in claim 1, wherein said driving means comprise a drive shaft supported by bearing means in a front end of said housing and extending outwardly through said front end, said front end of said compressor housing being provided with a shaft seal cavity through which said drive shaft extends, said oil passageway communicating between said second chamber and said shaft seal cavity, whereby the separated oil is returned from said second chamber to said first chamber through said oil passageway, said shaft seal cavity and said bearing means supporting said drive shaft.

6. The improvement as claimed in claim 5, wherein said oil passageway is formed through said compressor housing wall.

7. The improvement as claimed in claim 5, wherein said driving means further comprises a cam rotor mounted on an inner end of said drive shaft, and a wobble plate mounted on an inclined surface of said cam rotor through thrust bearing means and connected with said piston means, a gap being defined between said cam rotor and said wobble plate, said drive shaft being formed with a second oil passageway communicating between said shaft seal cavity and said gap between said cam rotor and said wobble plate, whereby a part of the oil in said shaft seal cavity is returned to said first chamber after lubricating said thrust bearing means between said cam rotor and said wobble plate.

8. The improvement as claimed in claim 1, wherein said cylinder head is provided with said outlet port in the rear end wall thereof, a partitioning wall transversely extending across said discharge chamber at the lower portion of said outlet port, a projection projecting radially inwardly on the inner surface of the peripheral wall which defines said discharge chamber and above said partitioning wall, to define an axial step on the inner surface of the peripheral wall, said step connecting with the end surface of said partitioning wall, and further projections projecting axially from the inner surface of said rear end wall and receiving and securing said plate member on projecting ends thereof, said conduit means of said plate member being provided with a radial flange at the projecting end thereof which is received onto, and is in tight contact with, the end surface of said partitioning wall and said axial step.

9. The improvement as claimed in claim 8 in which said partitioning wall is provided with an axial fin extending toward, but not reaching said plate member to define a second gap therebetween.

10. The improvement as claimed in claim 8, in which said flange is provided with a fin at the portion received on said partitioning wall, said fin extending toward, but not reaching said plate member to define a second gap therebetween.

* * * * *